US008092786B2

(12) United States Patent
Park

(10) Patent No.: US 8,092,786 B2
(45) **Date of Patent: *Jan. 10, 2012**

(54) DRY NAIL POLISH APPLIQUE AND METHOD OF MANUFACTURING SAME

(75) Inventor: Fa Young Park, Leonia, NJ (US)

(73) Assignee: Park Global Holdings, LLC, Leonia, NJ (US)

( * ) Notice: Subject to any disclaimer, the term of this patent is extended or adjusted under 35 U.S.C. 154(b) by 793 days.

This patent is subject to a terminal disclaimer.

(21) Appl. No.: 11/543,481

(22) Filed: Oct. 5, 2006

(65) Prior Publication Data

US 2007/0025936 A1 Feb. 1, 2007

Related U.S. Application Data

(63) Continuation-in-part of application No. 11/126,862, filed on May 11, 2005.

(60) Provisional application No. 60/570,713, filed on May 12, 2004.

(51) Int. Cl.
*A61K 8/00* (2006.01)

(52) U.S. Cl. ..... 424/61

(58) Field of Classification Search ..... None
See application file for complete search history.

(56) References Cited

U.S. PATENT DOCUMENTS

| | | | | |
|---|---|---|---|---|
| 4,903,840 | A * | 2/1990 | So | 206/581 |
| 5,415,903 | A * | 5/1995 | Hoffman et al. | 428/15 |
| 6,354,304 | B1 * | 3/2002 | Chang | 132/200 |
| 2004/0079381 | A1 * | 4/2004 | Han | 132/73 |

* cited by examiner

*Primary Examiner* — Brandon Fetterolf
*Assistant Examiner* — Craig Ricci
(74) *Attorney, Agent, or Firm* — Levisohn Berger, LLP

(57) ABSTRACT

A method of manufacturing a decorative appliqué and the appliqué itself are disclosed. At least two formulations of high viscosity decorative liquid such as liquid nail enamel are provided and heated. A layer of pressure-sensitive adhesive material is applied onto a substrate, and a layer of the formulations are applied adjacent each other atop the layer of adhesive material on the substrate. The two formulations are preferably of different colors and are preferably confined to separate portions of the appliqué. In one fingernail-shaped embodiment, a small crescent-shaped section contains one formulation, and the remainder contains another formulation. A score or perforation is made between the two sections to facilitate application as a "French manicure". Double-ended of such appliqués are preferably provided with side handling tabs to facilitate handling of the appliqués and enable use of both ends of the same appliqué.

7 Claims, 15 Drawing Sheets

DRY NAIL POLISH APPLIQUE AND METHOD OF MANUFACTURING SAME

RELATED APPLICATIONS

This is a continuation-in-part of U.S. patent application Ser. No. 11/126,862 filed May 11, 2005, which claims domestic priority from U.S. Provisional Patent Application No. 60/570,713 filed May 12, 2004, the subject matter of both of which is incorporated by reference herein.

BACKGROUND OF THE INVENTION

1. Field of the Invention

The invention relates generally to nail polish. More specifically, the invention relates to instantly dry film coatings of nail polish that one can apply to one's nails instead of getting a manicure or brushing on liquid nail polish.

2. Description of the Related Art

People have used nail polish to color or adorn their nails for hundreds of years. Conventionally, nail polish is applied in liquid form by a brush and then must dry. The drying process takes time, during which the nail polish wearer must be very careful of her nails so as not to smudge or ruin her polish job.

Commercially available nail polishes use predominantly ¼-second and ½-second nitrocellulose (approx. 300-800 centipoise as measured by a Brookfield viscometer operating at 60 rpm). The designation of "second" indicates how long a metal ball will take to fall to the bottom of a given-sized drum of the material; the longer the period of time, the greater the viscosity of the nitrocellulose. Adjustments to the viscosity are then made with small amounts (i.e., 1-5 w/w %) higher viscosity nitrocelluloses i.e., 40-60 second and 60-80 second. Such high viscosity nitrocelluloses have never been used at higher concentration than 1-5% because the resulting nail polish would be too thick to apply by brush. The composition of a typical nail polish (also called nail enamel) is approximately 25-32% solids and 68-73% solvents. Of the solids, on a weight/weight percentage, 6-12% is nitrocellulose (¼-second or ½-second), about 6-12% is resin and 6-10% is plasticizer. The remaining contents are typically as follows:

mica and color pigments 8-15%
ethyl acetate 20-30%
n-butyl acetate 20-30%
isopropyl alcohol 5-10%
miscellaneous 3-7%.

Because of the high solvent content, commercially available liquid nail polishes are flammable and must be shipped via ground or water unless indicated for special delivery and handling.

More recently, there have been developments in the field where dry or nearly dry film coatings of nail polish are available for application to a person's nails. Two patents that describe this type of appliqué are U.S. Pat. No. 4,903,840 to So and U.S. Pat. No. 5,415,903 to Hoffman et al.

The So patent, assigned to the instant assignee, teaches a basic method of making self-adhesive nail coatings of this nature. In the So patent, the nail coatings are made by using a mold having a pour hole and a slot or passage for a sheet of adhesively-backed paper to pass through or by. Conventional liquid nail enamel is poured onto the sheet of adhesively-backed paper as it is slowly drawn through the mold. A uniformly coated, adhesively backed nail coating sheet is thus created. The sheet is then dried for a predetermined time and at a predetermined temperature or until the sheet has the nail enamel coating in a semi-solid, yet not completely dried state. The strip is then preferably cut into sets of five fingernail coatings. The sheet is also preferably provided with a ribbon or tear strip which serves to facilitate the individual application of the nail coatings to the fingernails by easing removal of the coatings from the adhesive-backed paper. The sets of coatings, after partial drying, are encased in a substantially air-tight envelope until used.

The Hoffman patent teaches a similar dry nail coating that consists of a film-forming polymer layer containing at least one plasticizer (again, conventional nail enamel), a pressure-sensitive adhesive layer located thereon, and a carrier film or supporting foil which covers the pressure-sensitive adhesive layer and which can be removed and is preferably silicone-treated. The film-forming polymer layer is also covered on the other side (i.e., the top) with a completely removable protective layer which is resistant to the other constituents of the laminate and the materials used in the preparation of the laminate. The Hoffman patent adds little to the teachings of the So patent, other than the addition of the completely removable protective layer provided over the top of the enamel layer, which appears to be conventional in the art at any rate.

It would be desirable to be able to speed up the manufacture process of nail coating laminates. It would also be desirable to provide methods of creating nail coating laminates or appliqués of multiple colors, with patterns, with a metallic finish (heretofore unachievable in nail coating laminates), and the like.

It would also be desirable to achieve a "French manicure" effect, i.e., a white tipped appliqué with a pink, clear, or pearlescent main portion, that is easy to manufacture and then apply. It is additionally desirable to increase the ease with which a user of nail products can use and handle the product when she uses it herself.

SUMMARY OF THE INVENTION

The above and other problems in the prior art are solved by the invention, which is an improved self-adhesive nail appliqué or laminate, a method of making same, and an inventive liquid nail enamel for use in the inventive method. In the inventive method, an inventive high viscosity liquid nail enamel of various formulations is heated above 100° F., preferably to between 100 and 150° F. At least two layers of materials are deposited on a substrate of release liner paper or plastic film. All of the embodiments include at least the application of an adhesive coating on the substrate and the application of the inventive heated liquid nail enamel on top of the adhesive layer.

Optionally, a second coat of the inventive high viscosity liquid nail enamel may be applied. In addition or in the alternative, glitter or mica or similarly desirable particulate matter may be mixed with clear or translucent coating (i.e., similar to the inventive nail enamel but mostly or completely devoid of color pigments). A printing step may also be applied at this point, as may a holographic image. Finally, as another option or in addition to any of the above steps, a clear or translucent top coat may be applied as a final layer.

The inventive high viscosity liquid nail enamel achieves its high viscosity in one of a number of ways. In some formulations, ¼ or ½-second nitrocellulose is used, but in substantially higher percentages by weight than conventional nail polish; that is, conventional polish may have 25-32% solids by weight, whereas the inventive nail enamel includes 35-60% solids by weight. In other formulations, 60-80 second nitrocellulose is used in much greater proportions than conventional nail polishes. That is, conventional nail polishes may use 60-80 second nitrocellulose at about 1-5% by weight merely to tweak the viscosity of the polish. However, the instant invention may employ 60-80 second nitrocellulose as a predominant or major solid in percentages as high as 6-25%. The use of more solids or a more viscous enamel provides greater durability and flexibility in the end product. Also as a result of the inventive method, a greater percentage of solids in the enamel formulation results in a lower percentage of solvents being used. This lower solvent content has several advantages. From the standpoint of processing, the time required to complete drying/evaporation (i.e., to produce a finished product) is about 30-40% less than currently available liquid formulations. Second, the dry nail polish film of the present invention is better for the environment, since less solvents are released during the drying process.

More specifically, the invention includes a method of manufacturing a nail appliqué comprising the steps of providing a liquid nail enamel having high viscosity as described above (i.e., higher than 1500 centipoise at room temperature), heating the high viscosity liquid nail enamel to at least 100° F. applying a layer of adhesive material onto a substrate, and applying at least a first layer of the heated liquid nail enamel atop the layer of adhesive material. A second layer of high viscosity liquid nail enamel may be applied atop the first layer of high viscosity liquid nail enamel. The second layer may be substantially clear (i.e., substantially free of color or pigment) and/or may have particulate matter such as glitter or mica added thereto prior its application in the second layer. An image or design may be applied atop either the first or the second layer of high viscosity nail enamel by at least one of the following processes: silk screen printing, flexographic printing, gravure printing, digital printing, digital flexographic printing, offset printing, hot stamping, or holographic lamination.

The nail enamel layer is preferably partially dried via at least one of infrared heaters or hot air blowers, preferably prior to the deposition or application of the next layer. Finally, after the last layer is applied, the product is cut into substantially fingernail-shaped sections and packaged.

In addition or in the alternative to the above-described inventive method, the providing step may include the steps of providing at least two formulations of high viscosity liquid nail enamel and allowing the two or more formulations to mix passively during manufacture of the appliqué. The two or more formulations may have different viscosities or may be different colors. Optionally, one or more of the formulations may be of conventional liquid nail enamel viscosity. The passive mixing step may include the step of pumping each of the formulations into a common receiving tank via separate input hoses. The pumping step may utilize a common pump for all input hoses or a separate pump for each of the input hoses. The flow rate of each of the formulations may be controlled, for example, by providing different diameter input hoses for each formulation or by providing a separate pump for each of the input hoses and controlling the flow rates of each pump individually.

In addition to the above-described methods, the invention also includes a system for manufacturing a nail appliqué. The inventive system includes means for conveying a substrate sheet, preferably an unwind roller at the beginning of the system and a winding roller at the end of the system. A first station is positioned above the substrate sheet at a first position and applies an adhesive to the substrate sheet in a layer. A heating device is used to heat high viscosity liquid nail enamel. A second station is positioned above the substrate sheet at a second position downstream of the first position which applies the heated high viscosity liquid nail enamel to the substrate sheet in a layer atop the adhesive layer. In some embodiments, a third station is provided positioned above the substrate sheet at a third position downstream of the second position in communication with either the same or a different heating device. The third station applies heated high viscosity liquid nail enamel to the substrate sheet in a layer atop the previous nail enamel layer. Heaters are preferably positioned in thermal communication with the substrate, with at least one of the heaters being positioned downstream of the first position but upstream of the second position and at least another of the heaters being positioned downstream of the second position. The heaters may be either infrared heaters or hot air blowers or both. Downstream of a final material-applying station, a die cutter is positioned to cut the substrate and its various layers into substantially fingernail-shaped appliqués. Each of the stations preferably includes a slot die but may also or instead include a gravure printing device.

In one embodiment of the inventive system, the second station and the third station each receive different formulations of heated high viscosity liquid enamel. A first pump may be in communication with the second station for pumping one formulation of liquid enamel to the second station, while a second pump may be in communication with the third station for pumping a second formulation of liquid enamel to the third station. A receiving vessel is preferably interposed between the heating means and the second station that receives heated high viscosity liquid nail enamel from the heating device. The receiving vessel may include a plurality of input hoses, each of the input hoses capable of receiving and delivering to the receiving vessel a different formulation of high viscosity liquid nail enamel. Optionally, one or more of the formulations may have conventional liquid nail enamel viscosity. As another optional feature, a printing station may be provided downstream of the second station, adapted to print an image or design onto the enamel layer by at least one of the following processes: silk screen printing, flexographic printing, gravure printing, digital printing, digital flexographic printing, offset printing, hot stamping, or holographic lamination. A final station downstream of the printing station (or other third station, or initial second station) may be provided to apply a clear layer of high viscosity liquid nail enamel.

The invention also includes a self-adhesive nail appliqué having a removable substrate, a pressure-sensitive adhesive layer disposed on the removable substrate, and at least one layer of nail enamel made from high viscosity liquid nail enamel applied to the pressure-sensitive adhesive layer. The layer of nail enamel is made from either liquid nail enamel having at least 35% solid content by weight, or from liquid nail enamel having 60-80 second nitrocellulose as a predominant solid (preferably 6% or greater by weight). The inventive appliqué may include a second layer of nail enamel made from high viscosity liquid nail enamel that may be made from a different formulation of high viscosity liquid nail enamel than the first layer. Particulate matter such as glitter or mica may be added to either layer of nail enamel during manufacture. The optional second layer of nail enamel may be made from a substantially clear formulation of high viscosity liquid nail enamel. An image layer may be disposed atop the at least one layer of nail enamel, and the image layer may be formed via at least one of silk screen printing, flexographic printing, gravure printing, digital printing, digital flexographic printing, offset printing, hot stamping, or holographic lamination.

Most generally, the invention is a self-adhesive decorative appliqué for placement on a substantially flat surface. The appliqué includes a removable substrate and a pressure-sensitive adhesive layer disposed on the removable substrate. A layer of decorative coating made from a high viscosity decorative coating liquid is applied atop the pressure-sensitive adhesive layer.

The invention also includes a self-adhesive nail appliqué having a removable substrate, a pressure-sensitive adhesive layer disposed on the removable substrate, and a layer of nail enamel made from at least two formulations of high viscosity liquid nail enamel applied adjacently atop the pressure-sensitive adhesive layer. Preferably, the formulations of nail enamel comprise at least 35% solid content by weight and/or 60-80 second nitrocellulose as a predominant solid. More preferably, the formulations of nail enamel comprise 60-80 second nitrocellulose at 6% or greater by weight In a preferred embodiment, the formulations are of different colors and/or viscocities. The appliqué is preferably substantially fingernail-shaped having a first portion and a second portion, wherein the first portion includes a first of the formulations and the second portion includes a second of the formulations. More preferably, the first portion includes a first of the formulations of a first color and the second portion includes a second of the formulations of a second color. The first portion is preferably a relatively small substantially crescent-shaped area and the second portion is substantially the remainder of the appliqué. A score, perforation, or partial cut substantially divides the first and second portions to facilitate application as a "French manicure".

The invention also includes a set of self-adhesive nail appliqués, where each appliqué has a removable substrate, a pressure-sensitive adhesive layer disposed on the removable substrate, and a layer of nail enamel made from at least two formulations of high viscosity liquid nail enamel applied adjacently atop the pressure-sensitive adhesive layer. Each of the appliqués is substantially fingernail-shaped. More preferably, each of the appliqués has a first end and a second end, each of the ends being substantially fingernail-shaped and each of the ends being adapted for use on separate fingernails. The set of self-adhesive nail appliqués may also include a series of side tabs disposed between each of the appliqués and each being integrally attached to one of the appliqués and partially attached to an adjacent of the appliqués.

DETAILED DESCRIPTION OF THE INVENTION AND DRAWINGS

Figure 1:
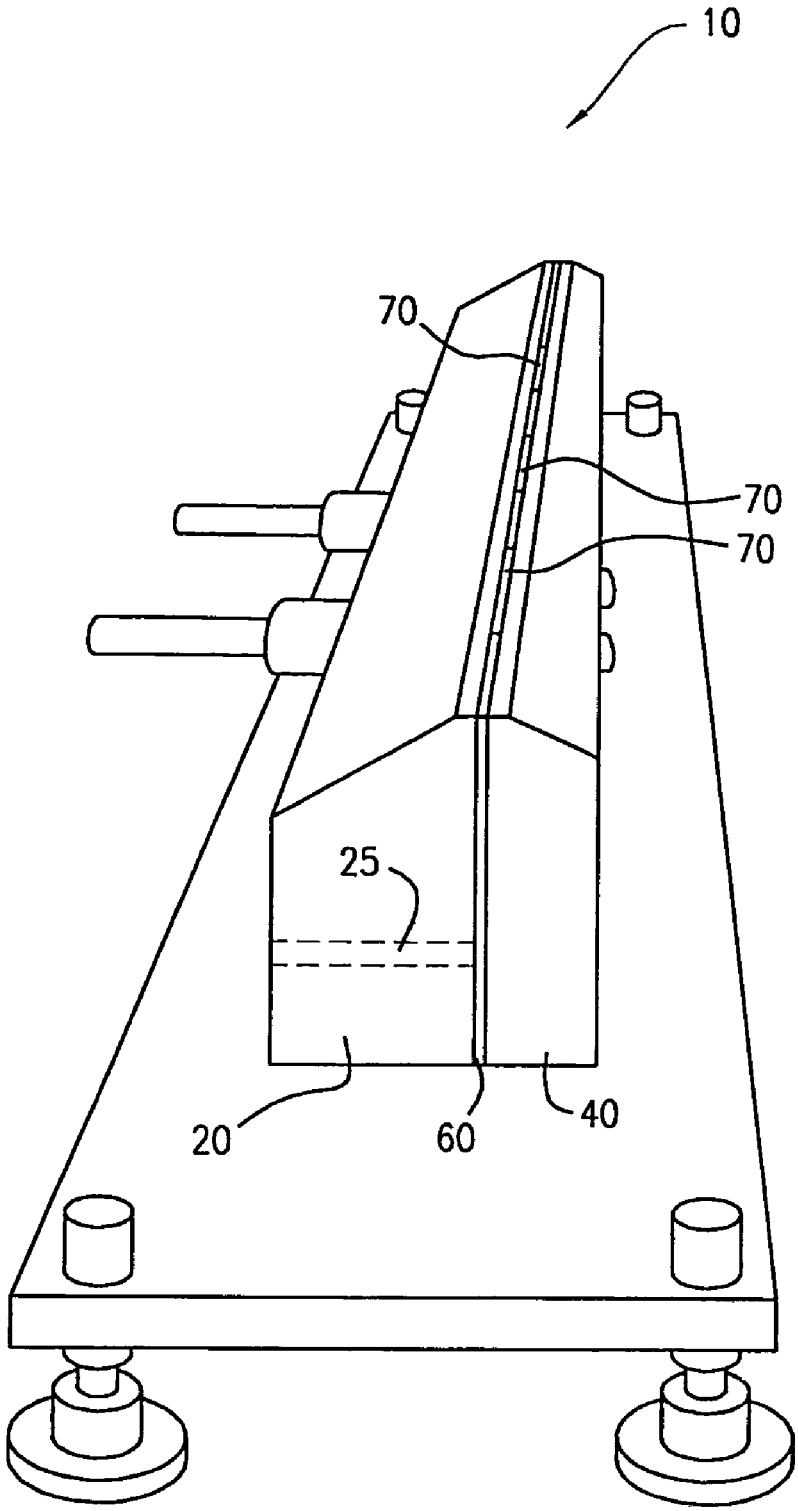
FIG. 1 is a bottom perspective view of a slot coating die used in the inventive method.
Figure 2:
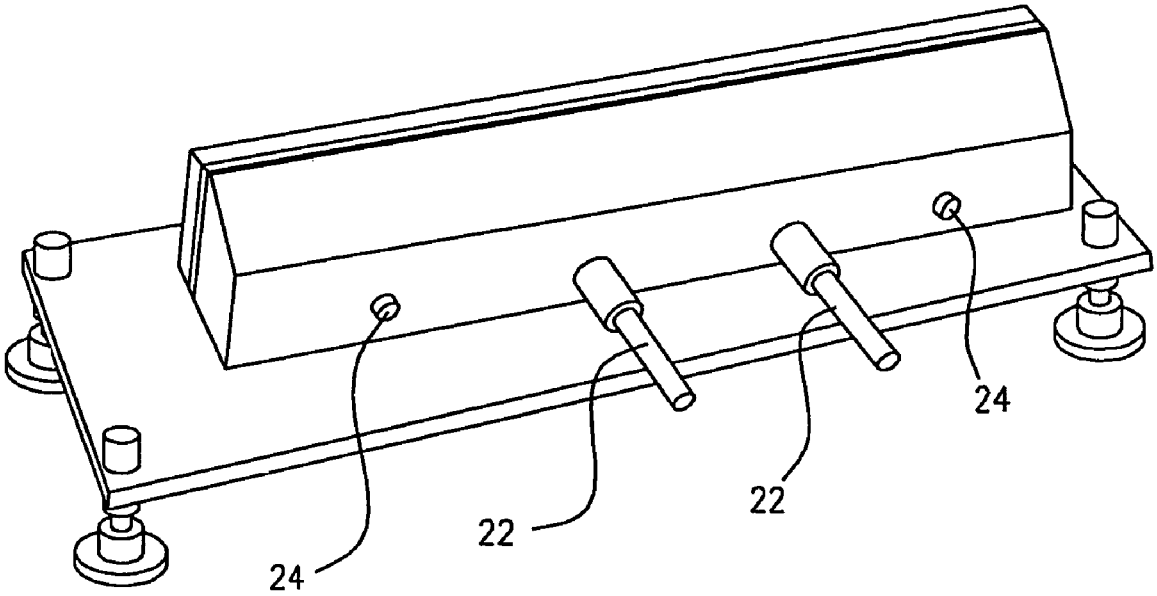
FIG. 2 front bottom perspective view of the slot coating die of FIG. 1.

Generally, the invention includes a method of making strong, durable, and beautiful dry nail enamel appliqués as well as the appliqués themselves. As used herein, the term "appliqué" means the final end product to be applied to one's nail, whereas "film" refers to the broader uncut product. In the inventive method, 2-5 layers of various formulations are applied via coating processes to be described below on commercially available 4-5 mil (approx. 100-130 mic.) silicon-coated release liner paper or aluminum laminate plastic film, generally referred to as the substrate. The substrate is preferably unspooled from a roll or similar structure on an unwinding roller at the beginning and taken up by a winding roller at the end of the process in a manner known in the printing arts. Any other conventional means of advancing or conveying the substrate is contemplated as part of the invention. Multiple coating steps are employed to achieve various end products, all of which last longer and are shinier than conventional semi/dry nail polish coatings and effects as well as increased efficiency of production.

The basic process includes heating a novel formulation of liquid nail enamel to preferably between 100 and 150° F. This may be accomplished by a heat drum with the heating element inside, or by an immersion heater, or by a flexible wraparound heater, or a steel band drum heater, or any known or to be invented means for heating liquids. An adhesive coating (layer 1) is applied to the release paper in the amount of about 5-24 g/m$^2$. The liquid nail enamel is next applied in a coating (layer 2) of approximately 0.5-3.5 mil in thickness. Optionally, this step may be duplicated, i.e., another coating (layer 3) of about 0.5-3 mil of liquid nail enamel may be applied. Glitter or mica or similar desirable particulate matter may be mixed with clear or translucent coat and next applied in a coating (layer 4, also 0.5-3 mil). Finally, a clear top coat or translucent color coating (layer 5, 0.5-3 mil) is applied.

Description of the inventive nail enamel will now be given. The inventive nail enamel includes a much higher solids content (35% and up) and/or higher viscosity nitrocellulose (60-80 second and up) than conventional nail polish. These characteristics cannot be used in conventional nail polish because the resultant polish would be too thick (i.e., it would have too high a viscosity) to apply by brush. From a mass manufacturing point of view, however, the less volatile solvent in the formulation, the greater the production capacities. In addition, higher viscosity nitrocellulose (60-80 second) can produce thinner but stronger and shinier film. The multi-layer film has great flexibility in manufacture and can provide a variety of different products.

Three examples of the basic composition of high viscosity liquid raw nail polish for processing and product of semi-dry or dry (hereinafter "semi/dry") nail polish film follow.

Example 1

A non-metallic dry nail polish film of the present invention uses 35-60% solids, of which 25-35% (w/w) is ¼- and ½-second nitrocellulose. In contrast, conventional bottled liquid nail polishes contain, at most, 13-17% nitrocellulose. The present invention thus doubles the solid content. The present invention includes about 40-50% solvents, as opposed to approximately 70% of solvent used in traditional liquid nail enamels. This lower solvent content has several advantages. From the standpoint of processing, the time required to complete drying/evaporation (i.e., to produce a finished product) is about 30-40% less than currently available liquid formulations. Second, the dry nail polish film of the present invention is better for the environment and energy saving for oxidate solvents. This nail polish formulation is impossible to use with a brush because it is too thick; however, in the present invention, the formulation is heated to about 100-150° F., thereby reducing the viscosity and allowing the material to flow through the nozzle. The first, non-metallic formulation is as follows:

| | |
|---|---|
| 25-35% | ¼ or ½ second nitrocellulose |
| 8-12% | Polymer, co-polymer resin(s) (e.g. acrylic, polyester, Polyurethane, etc.) |
| 8-17% | Plasticizer |
| 7-12% | color pigments |
| 18-25% | Ethyl Acetate |
| 18-25% | Butyl Acetate |
| (total-solids 35-60%) | |

This formulation is approximately 1500-4000 centipoise (60 rpm) at room temperature.

Example 2

As mentioned above, high viscosity nitrocellulose (60-80 second) is conventionally used in less than 1-5% amounts solely for the purpose of adjusting enamel viscosity using less than 5% for bottled chrome nail polish. One manufacturer of such a formulation is Kirker Enterprises in New Jersey, as described in U.S. Pat. No. 6,565,835 to Socci et al. By contrast, the inventive metallic or non-metallic formulation contains high viscosity nitrocellulose (60-80 second) in quantities greater than 6%, up to 25%. By using such a high percentage of extremely viscous nitrocellulose, thinner, shinier films with greater strength and flexibility are possible. This formulation is as follows:

| | |
|---|---|
| 6-25% | 60-80 second nitrocellulose |
| 8-12% | polymer, co-polymer resin(s) |
| 5-10% | color pigments |
| 4-15% | plasticizer |
| 1-2% | other solids |
| remainder | solvent(s) (e.g., ethyl and butyl acetates, isopropyl alcohol) |

This formulation is approximately 1500-4000 centipoise (60 rpm) at room temperature.

Example 3

A third formulation combines the "best of both worlds" of the first two mentioned above. Specifically, the composition of this formulation includes both high viscosity nitrocellulose (60-80 sec.) and ¼ or ½-second nitrocellulose in a 40%-60% combination (with respect to each other). This formulation achieves a thinner film with medium strength and flexibility as well as shine:

| | |
|---|---|
| 8-17% | ¼ or ½-second nitrocellulose |
| 6-15% | 60-80 second nitrocellulose |
| 8-12% | polymer, copolymer resin(s) |
| 5-10% | color pigments |
| 4-15% | plasticizer |
| 1-2% | other solids |
| remainder | solvent(s) (e.g., ethyl and butyl acetates, isopropyl alcohol) |

This formulation is also approximately 1500-4000 centipoise (60 rpm) at room temperature.

In all three examples given above, the differences and benefits of the new inventive formulations for semi/dry nail enamels as compared to conventional liquid nail polish are manifold. They produce a stronger film on the nails which lasts much longer than either conventional nail polish or conventional semi/dry nail enamel appliqués. The film is also shinier than those previously produced. The inventive film appliqués are thinner than either conventional salon nail polish jobs or prior appliqués, thereby allowing the nail more breathability. The films are also flexible and may be easily stretched to cover a nail more fully and completely than before with less solvent remaining (less than 5%). Many different types of films can be produced without significant retooling of the machinery. Finally, since there is a much greater percentage of solids, more film can be produced faster and less expensively.

In conventional coating processes for manufacturing dry nail enamel films, the nitrocellulose base must be of sufficiently low viscosity to flow through very small apertures (i.e., slots and holes of less than 300 microns in slot) in the coating die. Because nail polish formulations (with nitrocellulose bases) having a viscosity of greater than 1000 centipoise generally will not flow readily and would quickly clog the die (especially those containing glitter or large particle mica), 60-80 second nitrocellulose and the like are typically not used in the manufacture of nail polishes, other than in small amounts (e.g., up to a maximum of 5%, typically from 1-3%, for adjusting viscosity of the final product as mentioned above). In the present invention, by heating the formulation to between 100-150° F., preferably about 125° F., higher viscosity nitrocellulose may be pumped and used. Similarly, where the content of ¼ or ½-second nitrocellulose is greater than about 35% by weight of the composition, then the formulation must be heated to about 100-150° F., preferably to about 125° F.

Description will now be given with reference to the attached FIGS. 1-17. It should be noted that these drawings are merely exemplary in nature and in no way serve to limit the scope of the invention, which is defined by the claims appearing hereinbelow.

The various coatings of the product are applied via a technique referred to herein as "slot curtain die coating." The die in question is shown in FIGS. 1-4 in various states of assembly as die 10. As best shown in FIG. 1, die 10 includes front die section 20, rear die section 40, and a specially shaped shim 60 disposed therebetween. All three parts are tightly secured together, preferably by bolting, e.g., by bolts 24 (see FIG. 2). Front die section 20 includes inlets 22 which feed internal bores 25 with liquid nail enamel or any of the other components of the product.

Figure 3:
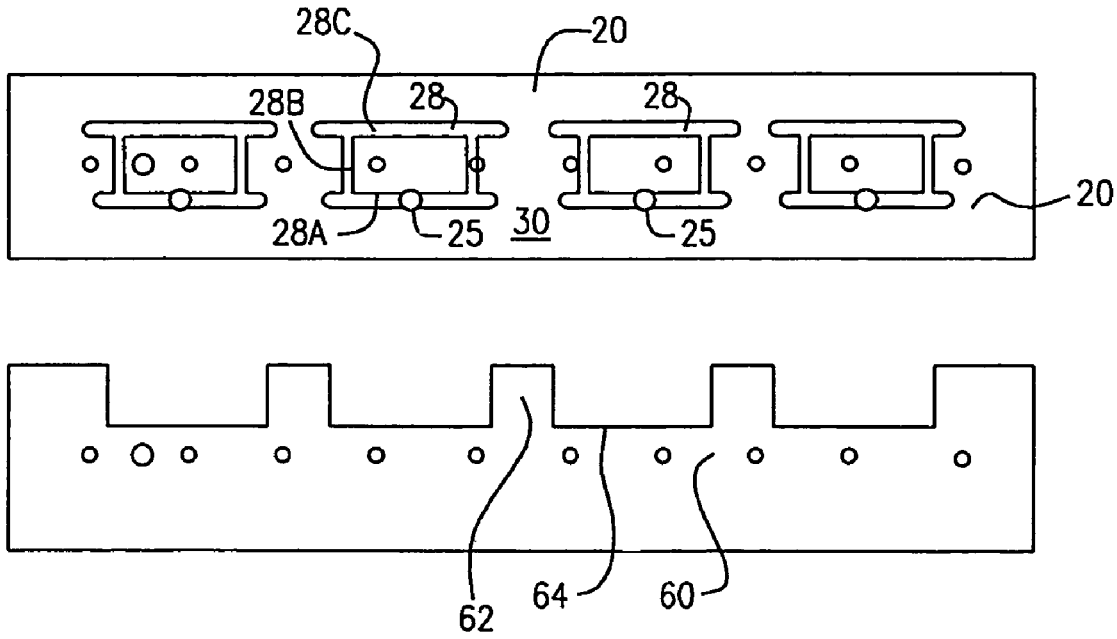
FIG. 3 is an elevational view of a shim and half of the slot coating die of FIG. 1 dissembled.
Figure 4:
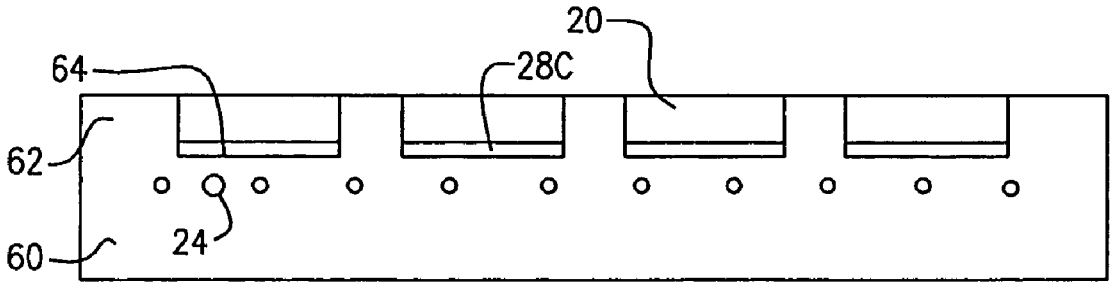
FIG. 4 is an elevation view of the shim and die half of FIG. 3 assembled.

FIGS. 3 and 4 illustrate the interior of die 10; in both of these figures, rear die section 40 has been removed for clarity. Internal bores 25 of front die section 20 terminate in outlet holes 26 on inner face 30 and reside in flow channels 28 thereon. The purpose of flow channels 28 is to direct the liquid nail enamel from outlet holes 26 in a manner that results in consistent and even application of the enamel on the substrate. As such, each flow channel 28 include upper substantially horizontal branch 28A which feeds into substantially vertical branches 28B and thence into lower substantially horizontal branch 28C. It should be noted that die 10 is shown in FIGS. 1-4 upside down; hence, fluid exiting outlet hole 26 seeps along horizontal branch 28A, down vertical branches 28B, and then seeps into horizontal branch 28C. The liquid enamel seeps from branch 28C and onto the substrate.

Without shim 60, the two inner faces of front and rear die sections 20 and 40 would be firmly abutting and would not allow room for the enamel to seep out of horizontal branch 28C. However, as shown in FIGS. 3 and 4, shim 60 includes vertical projections 62 between cutouts 64. When shim 60 is attached to front die section 20 by bolts 24 (see FIG. 4), it shields and covers all of flow channel 28 except for the majority of lower horizontal branch 28C. This way, enamel flowing in branches 28A or 28B cannot seep out of these branches but must instead move forward (downward) ultimately to branch 28C. Because branch 28C is uncovered, enamel simply spills out of it and thus out of slots 70 (see FIG. 1) and onto the substrate in a sheet-like or curtain-like configuration.

Figure 5:
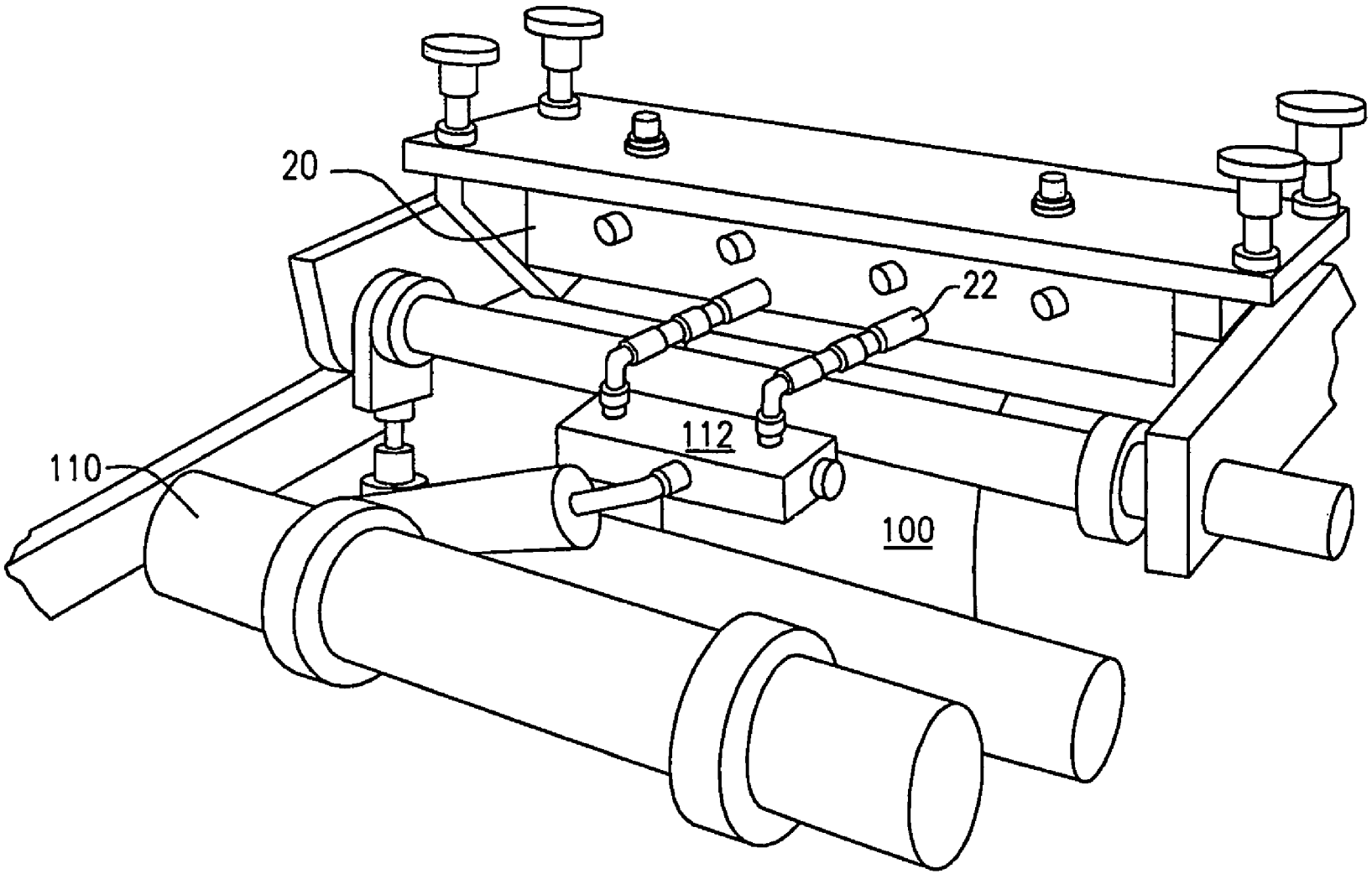
FIG. 5 is a front perspective view of a coating apparatus used in the inventive method.
Figure 6:
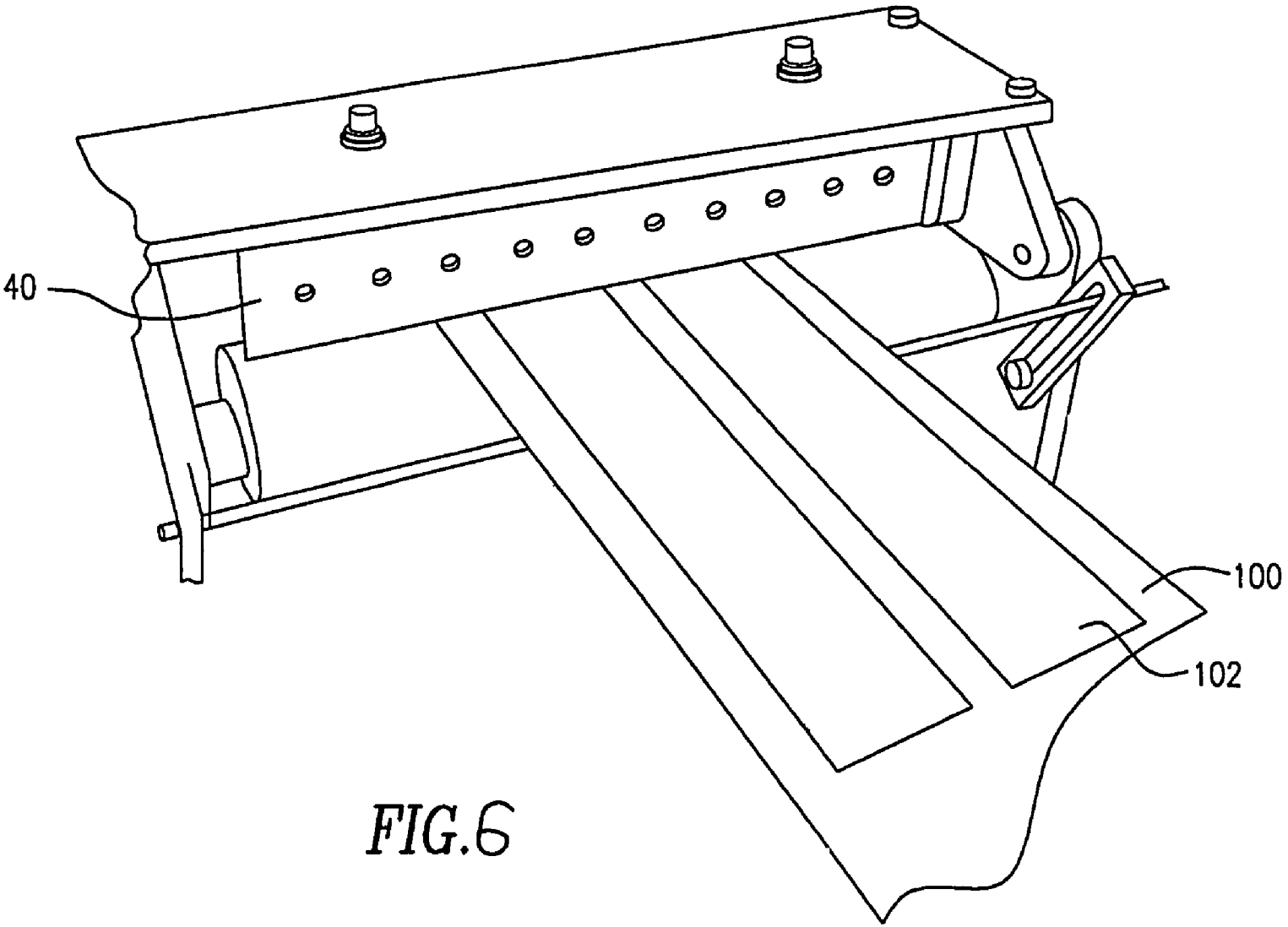
FIG. 6 is a rear perspective view of the coating apparatus of FIG. 5.

More specifically, as best illustrated in FIGS. 5 and 6, substrate 100 is fed into the machinery by rollers 110. Liquid enamel source 112 is attached to inlets 22 so that heated, pressurized liquid enamel can be forced into die 10. When substrate 100 passes under die 10, liquid enamel or other components being coated, fall out of slots 70 and onto substrate 100 thereby forming layer 102.

Not all layers need be formed in this manner. For example, the adhesive layer may be rolled on or may be hot melted on from an originally solid state. Also, not all layers need be of high viscosity liquid nail enamel. For those layers being made from conventionally viscous liquid nail enamel, it is not necessary to heat such enamel.

Figure 7:
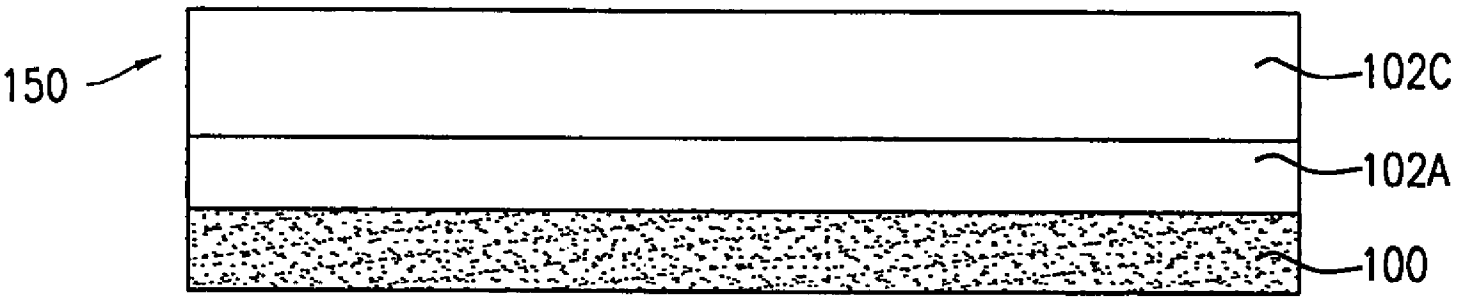
FIG. 7 is a sectional schematic view of a 2-layer nail product in accordance with the invention.
Figure 8:
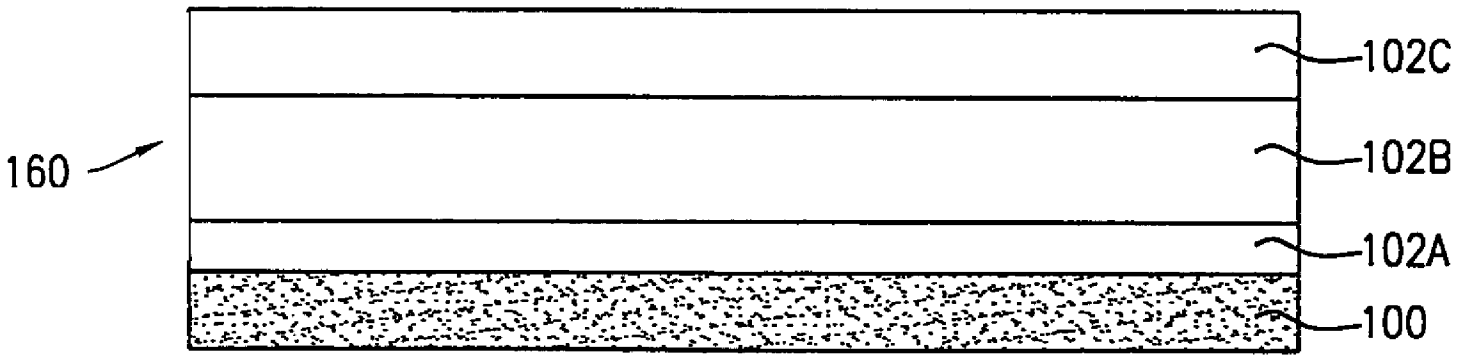
FIG. 8 is a sectional schematic view of a 3-layer nail product in accordance with the invention.

FIGS. 7-10 depict various different products (all nail enamel appliqués or films) having various layers that may be made in accordance with the invention. FIG. 7 depicts a basic product 150 of the invention, having substrate layer 100, adhesive layer 102A, and clear coat layer (or translucent color coating) 102C. In this product, adhesive coating 102A is applied preferably in the range of 5-24 g/m$^2$, and clear/translucent layer 102C is applied in the range of 0.5-3.0 mil. FIG. 8 depicts a product 160 having the same layers as in FIG. 7, but also including another nail polish layer 102B having color; layer 102B is preferably applied in the range of 0.5-3.5 mil.

Figure 9:
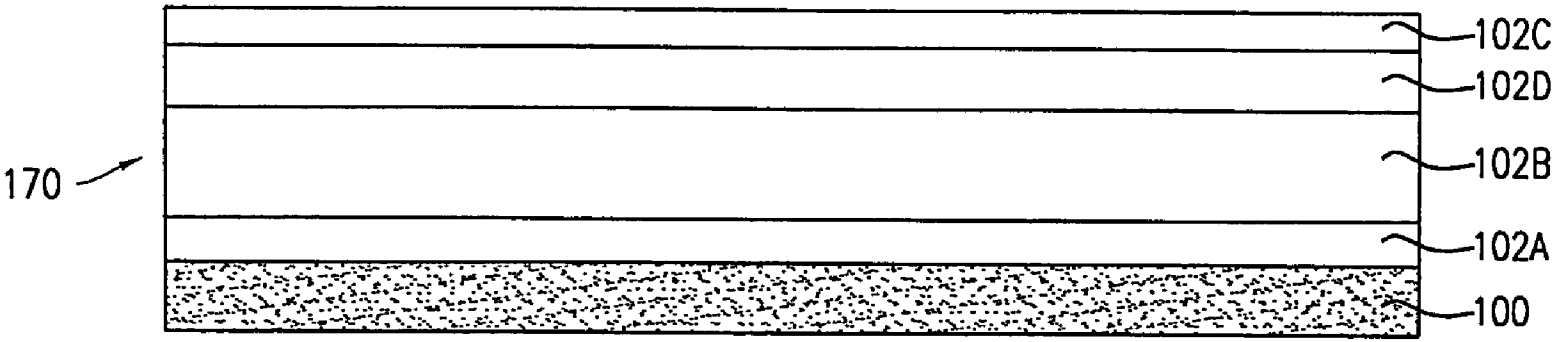
FIG. 9 is a sectional schematic view of a 4-layer nail product in accordance with the invention.

FIG. 9 depicts a product 170 having the same layers as in FIG. 8, but also including effects layer 102D applied atop nail color layer 102B and before the application of clear/translucent coat layer 102C (0.5-3.0 mil). By "effects" it is meant some form of special effects such as glitter, mica, similar particulate matter, or the like. Sparkling glitters makes for a deep 3-dimensional appearance and also creates "star bright" effects when used in the inventive semi/dry nail polish. To manufacture such a product, commercially available glitter or glitters (made from colored plastic, mica, or the like) is mixed with liquid nail polish, either the inventive high viscosity liquid nail enamel or conventionally viscous liquid nail enamel. It is preferred to use a bigger slot 70 in die 10 (10-30 mil, depending on particle size) to make it easier to for the particles contained in the enamel to land successfully and evenly on substrate 100 without clogging slot 70.

Many different types of products and effects can be created by use of glitter. As one example, mixing glitter or glitters (mica and/or plastics and/or others) with any clear or colored nail polish formulation having pigments and employing the inventive coating process results in a nail appliqué having a sparkling monochromatic finish. Glitter may also be mixed with a light translucent color (e.g. light blue or light pink—having less pigments than the standard color layer), which in turn can be placed on top of a previously applied film, creating a new glitter effect. For example, a light blue translucent glitter appliqué applied on top of previously applied red nail appliqué produces a purple color. One or more nails appliqués of differing colors may be included in the same package to allow the user to mix and match colors in this way. Glitters can also be mixed with a clear coat layer to be applied atop the plain, multi-layer, printed (to be described) or other nail polish coating, then covered by one more layer of clear top coat. The effect is glittery yet smooth. Alternatively, dry glitter (mica or plastics or others, 1-30 micron) may be swirl dropped or curtain dropped on the product right after the color nail polish coating or clear coating is still wet, and then a top coat may be applied. As stated above, particulate matter may be added to conventionally viscous liquid nail enamel as well as to the high viscosity liquid nail enamel described above.

Figure 10:
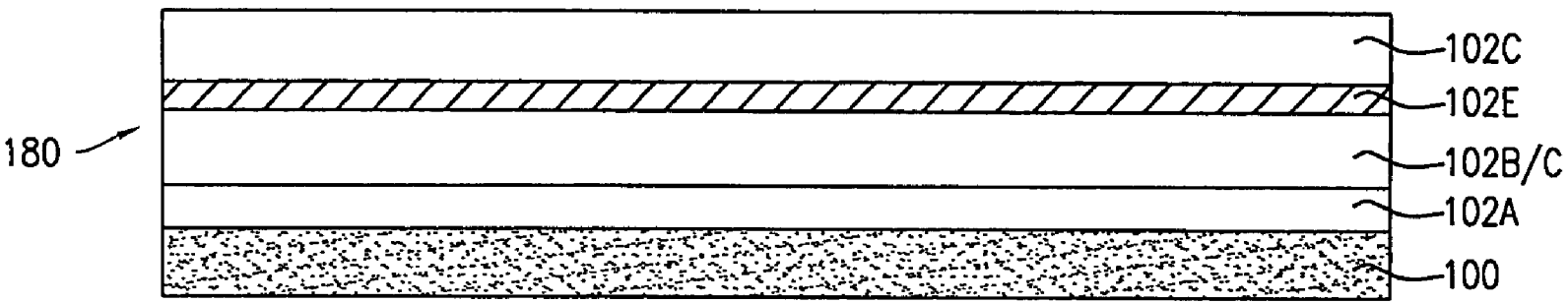
FIG. 10 is a sectional schematic view of another 4-layer nail product in accordance with the invention.

FIG. 10 depicts a product 180 having all of the previous layers as described in FIG. 9 but also including a printing layer 102E applied atop layer 102B/C (i.e., either a color layer or a clear layer may be employed) but prior to top clear coat layer 102C. The printing can be a single color or multicolor process printing and may be accomplished by various styles of designs, animations, pictures, etc., printed by industrially available flexographic, gravure, offset printing and silk screening technology on semi/dry nail polish film.

As described conventionally and in the So patent mentioned above, only the pad printing method was available. Now, by use of the inventive method, many other processes are available to print images on semi/dry nail polish. One such process is flexographic printing. In this process, designs or images are engraved on rubber, polymer, or other commercially available plates affixed to a cylinder to print on the surface of semi or dry nail polish. Another such process is gravure printing, in which designs or images are engraved on a metal cylinder to be applied to the semi/dry nail polish film. Other possibilities include digital printing, digital flexographic printing, offset printing, hot stamping, and silk screening.

The advantages of the current method over the pad printing process claimed in the So patent are numerous. The instant process is almost 10 times faster at speeds of up to 50 feet per minute. The instant process also allows the manufacturer to print images, including photographs, using a four-color process (e.g., CYMK, a color-specifying system the uses the subtractive primary colors cyan, yellow, magenta, and black). Also, the inventive process results in sharper, better resolution images. As another alternative, using standard and UV inks, under black light as at night clubs or bars, designs become visible or hidden designs can appear. Panoramic images or sentences, i.e., one per image of word or letter per nail, may also be achieved (e.g. Manhattan skyline, "I love you," etc.).

Many other various products can be created using the inventive method. As another example, multi-color gradation or striped nail polish film, with a design known in the industry as "vignette" can be created. For this type of product, two to five of nail polish colors are naturally or passively mixed and create vignette images.

The multicolor effect is achievable by more than one method. First, using a single pump, two to five different color liquid nail polishes of the same or differing viscosities (either conventionally viscous or high viscosity) are pumped up through the main hose via separate various inlet hoses into a common receiving tank. All colors are naturally or passively mixed in the pump (downstream of the receiving tank) and a single main hose (which feeds die 10) without further forced mixing of the mixture. A single coating die deposits the mixed colors onto the release liner. Since the various colors do not blend homogeneously, color variations and striping result in a very aesthetically appealing look. More particularly, the individual color nail polishes of viscosities ranging from 400 to 2500 centipoise, preferably from 500 to 1700 centipoise, are pumped through separate input hoses, varying in diameter from 1/16 to 1 inch, preferably from 1/8 to 3/4 inch, into a common receiving vessel. From the receiving vessel, the combination of liquid nail polishes is pumped without further mixing into a single main hose, preferably from 5/8 to 2 inches in diameter.

Alternatively, multiple pumps may be employed. Specifically, from two to five pumps each respectively pump one of two to five different color liquid nail polishes of the same or differing viscosities, each through separate inlet hoses of same diameters with various pump speed for control amount of color nail polish liquid, into a common receiving tank. As above, the mixture is not forcibly mixed in the receiving tank, and it is pumped into several inlets of the coating die 10 and thence onto the substrate 100.

Yet another product available to the manufacturer using the inventive method is a semi/dry nail polish film utilizing holographic images. Commercially available holographic images may be laminated on semi/dry nail polish. Holographic images formed on paper or plastic film are broadly used in a variety of applications. In the inventive manufacturing process, commercially available pre-printed holographic images (e.g, those made by Crown Roll Leaf, Inc.—Paterson N.J.) may be transferred to the surface of semi/dry nail polish coating by lamination process. Specifically, first apply a coating of adhesive (8-13 microns in thickness) to release liner and allow the adhesive coating to dry completely. Next, apply a liquid formulation (preferably one of Examples 2 or 3 above, but also possibly one of conventional viscosity) of clear collodion or color nail coating atop the adhesive layer. Allow the resulting film to dry until 2-15% solvent remains, thereby retaining flexibility of the film. Thereafter, laminate the film with commercially available transferable holographic film with one or more holographic designs using an industrial heat laminator of the type known to skilled artisans. Finally, apply clear nail polish coating to the film, allow it to dry until 3-15% solvent remains, then die cut to nail shape and package.

Another product available from the inventive method is a chrome semi/dry nail polish film. The product has a beautiful metallic shine that is not as shiny as a holographic level of shine but has its own characteristic of fine metallic color. It is made by using the formulation of Example 2 above having that heavier loading 10%-25% of 60-80 sec. nitrocellulose. This higher viscosity nitrocellulose produces a much stronger, longer-lasting, more lustrous dry nail polish film. More particularly, the chrome dry nail polish film of the present invention lasts for up to 2 weeks. In contrast, commercially available liquid chrome nail polish that a person would brush on has a longevity of only 2-5 days.

Yet another product that can be made by the inventive process is a nail film or appliqué having a white or other colored tip like a "French manicure." In most conventional salon French manicures, the polish application process must be performed in two or more steps. This renders the technique very difficult for the ordinary consumer looking to apply her own French manicure. However, with the current invention, the user need only apply the semi/dry appliqué to her nails in one step, and the French manicure look is achieved. It should be noted that in the previous So patent (U.S. Pat. No. 4,903,840), the phrase "french manicure" is used to mean "elegant" or "high class," not specifically the white- or other color-tipped nail usually meant by the term.

A french manicure effect may be created by printing the curve of french manicure tip shape (e.g., white, gold) on top of a solid light color dry nail polish film (e.g., light pink, cream, peach) manufactured according to the list below. After the french manicure tip shape is imprinted, a clear top coat is applied, and the resulting film allowed to dry until about 3-8% solvent remains. The final nail shape is register-cut and packaged. The printing methods contemplated as best achieving the French manicure include but are not limited to silk screening, flexographic printing, gravure printing, digital printing or Digital Flexo, offset printing, and hot stamping. Alternatively, the tip portion may be made as a separate piece by the inventive method. That is, a separate somewhat crescent-shaped piece may be made from a separate substrate and cut separately from the main nail appliqué. The two pieces may be sold separately, or sold within the same packaging but separated from one another, or they may come pre-assembled (with the tip piece being pre-applied onto the upper portion of the main appliqué).

Figure 15:
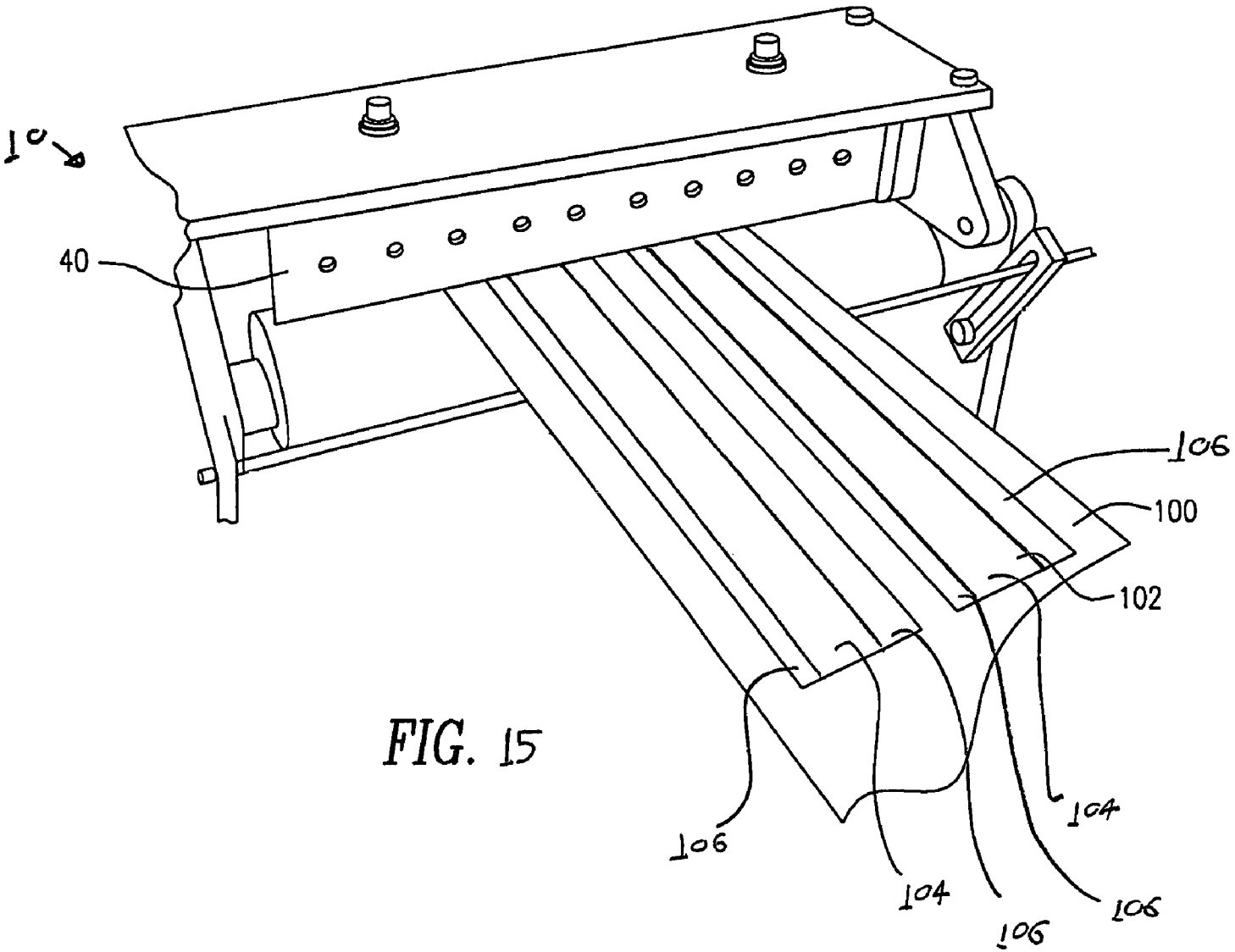
FIG. 15 is a rear perspective view of the coating apparatus of FIG. 5 being used to create a further embodiment of a nail appliqué product in accordance with the invention.
Figure 16A:
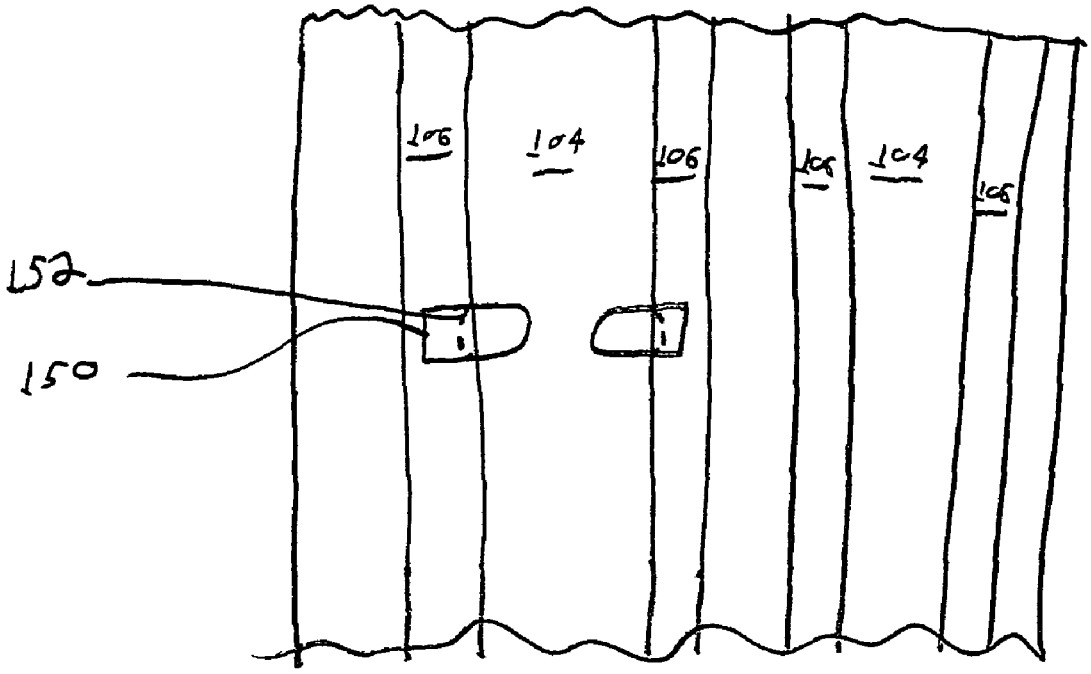
FIG. 16A is a schematic showing the representative cutting of a nail appliqué of the further embodiment of the invention.
Figure 16B:
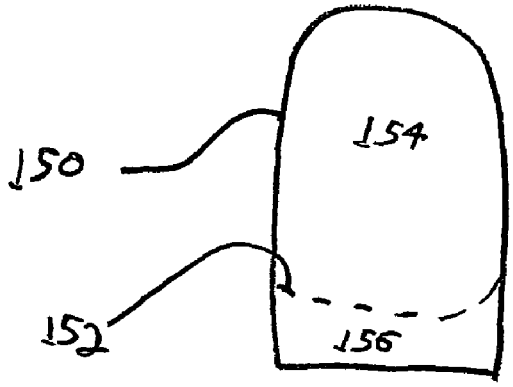
FIG. 16B is a schematic of the further embodiment of the nail appliqué cut in FIG. 16A.
Figure 16C:
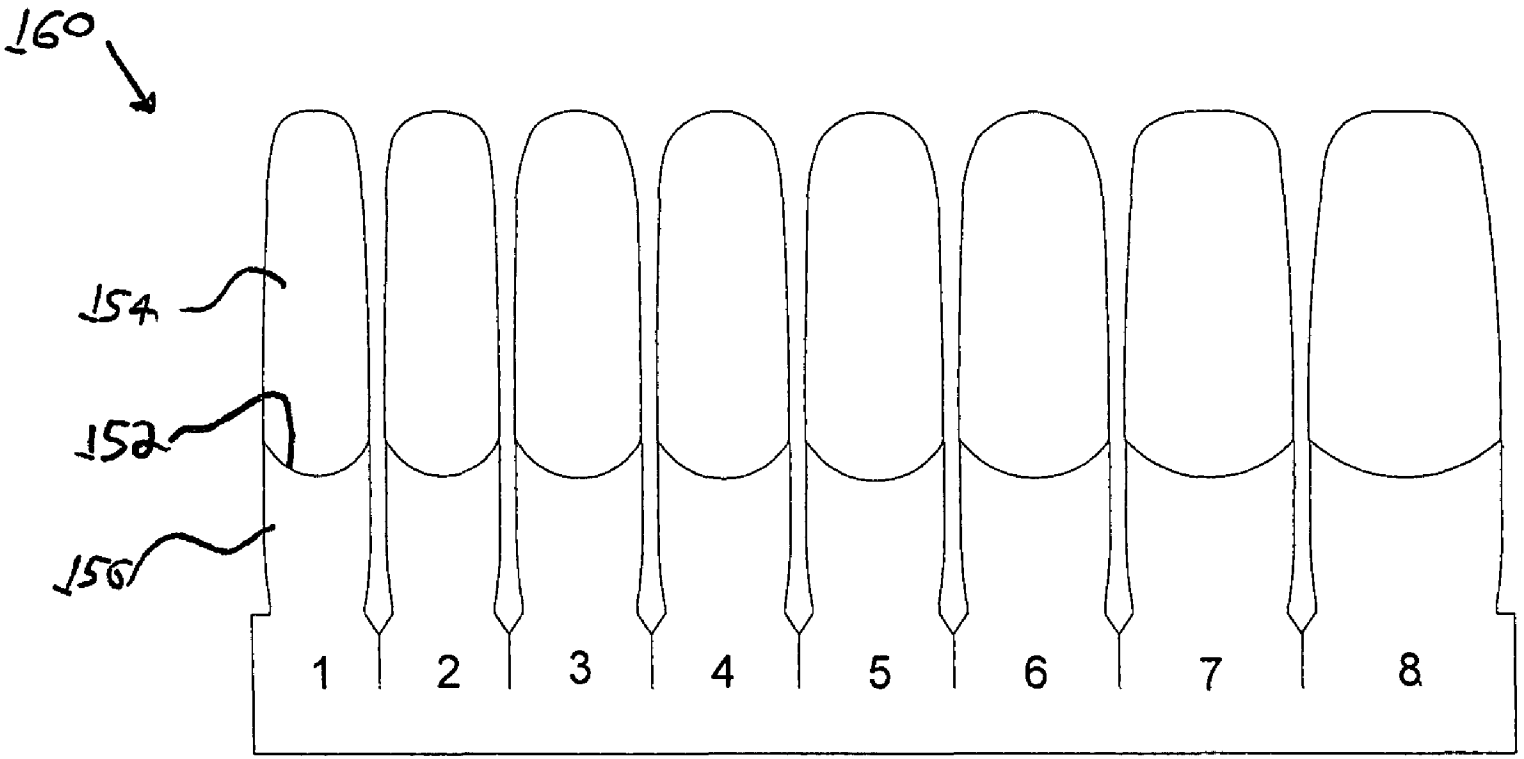
FIG. 16C is a top elevational view of a set of the nail appliqués of FIG. 16B.

One extremely efficient and superior method of preparing French manicure appliqués is shown in FIGS. 15-16. It is mentioned above that the appearance of the coating of enamel on the substrate when using more than one color of enamel may be varied by, among other methods, varying the pump speed of each color of enamel, varying the viscosity of each color of enamel, and the like. Through these and other methods, it is possible to achieve substantially no mixing of two colors and instead to lay down the different colors of enamel as adjacent but discrete stripes having clearly defined borders, even with the same coating die. As shown in FIG. 15, die 10 is applying two sections of an enamel layer 102 onto substrate 100. Each section of enamel includes a central portion 104 of one color and two border portions 106 of a different color. In the case of manufacturing a French manicure, it is preferred that the central portion 104 be a light pink and the border portions 106 be white, however substantially any colors can be used. In FIG. 16A-B, appliqués 150 are cut out of central and border portions 104 and 106 so that a single appliqué 150 has a first section 154 of one color (e.g., pink) and a second section 156 of a second color (e.g., white). The two sections 154 and 156 are divided by a score or perforation 152 which is a partial-depth cut or kiss cut made during the cutting process (e.g., with the same rotary cutting die). FIG. 16C depicts a set 160 of such two-sectioned appliqués 150.

In use, the French manicure appliqués 150 are used as follows. First, the white section 156 is detached from the pink section 154 and applied to the tip of the user's fingernail oriented so that the curved border of section 156 (where perforation 152 was) is placed closer to the proximal cuticle end. The tip section 156 is smoothed out, and any portion that extends over the end of the nail is removed. Next, the pink section 154 is placed over the entire nail, from cuticle to tip, covering the already-applied white tip section 156. This, too, is smoothed out and excess portions are removed. The result is a beautiful French manicure. It should be noted that the pink section 154 may be applied first with the white section 156 being applied atop thereto.

Finally, as alluded to above, sets of mix-and-match semi/dry nail polish may be provided. For example, multiple translucent color or glitter semi/dry nail polish appliqués may be put one on top of other, result changing color and effects. The product is essentially the same as the 2- or 3-layer products described above, however the amount of pigments for each layer (or each film, in the aggregate) has to be a minimal amount to reach translucent color film. For example, a blue set of appliqués can be sold or otherwise combined with a yellow set and generate green color where they overlap. It is not required that the two (or more) different colored appliqués be the same exact size or configuration. One could be smaller than the other to create a bordering effect. Alternatively, one could be smaller than the other and shaped in a non-nail-shaped configuration (e.g., a star, a heart, a letter, etc.).

Figure 11:
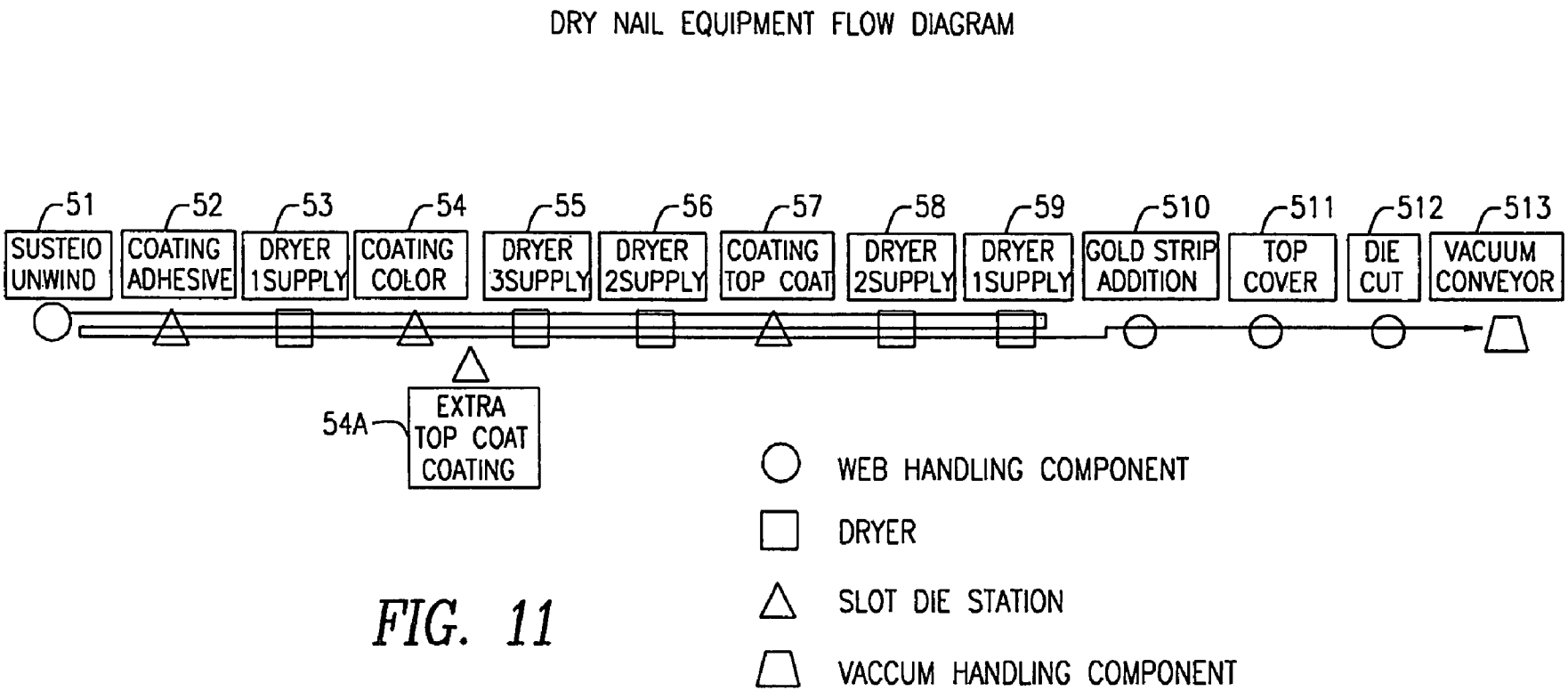
FIG. 11 is a flow chart of the inventive method.

The preferred manufacturing process will now be described in more specific detail. FIG. 11 represents a process diagram schematically showing the various steps of the inventive manufacturing process. In the prior So patent, the substrate was firmly pressed against the mold and slowly drawn through a passage of the mold to coat nail polish (see, e.g., So patent FIGS. 3A and 3B). The inventive method uses a slot coating die which never touches substrate while coating. Coating weight is adjustable by adjusting either pump speed (rpm), web speed, or both. Also, the inventive method utilizes multiple coating steps instead of the single coating and curing step of the prior art.

As shown in FIG. 11, at step S1, substrate web 100 is unwound from a spool and is threaded into the (conventional) conveyance system of the invention. At step S2, the adhesive coating layer 102A is applied. At this step, liquid adhesive is applied by slot die coating method, or solid adhesive is applied via a hot melting method. Coating thickness will be 5-20 micron, having an ideal weight of 5-24 g/m$^2$. The film peeling strength is 2.0-2.8 PLI (pound per linear inch) with a standard deviation of 0.2 PLI. Testing is applied to stainless steel testing panels according to PSTC (Pressure Sensitive Tape Council) test method 1 and given 15 minutes of dwell time. Peeling adhesion was determined by pulling the sample in an Instron® machine set at 180°. At step S3, the adhesive is cured for 1-5 minutes in a dryer which uses 400-600° F. infrared heaters and 130-200° F. hot air by knife nozzle in various spots along the production line.

The second coating step is depicted in step S4. This coating is the (color) nail polish coating which is deposited on top of the first adhesive coating. This coating step is achieved by the slot curtain coating die described above, and the coating thickness is 15-40 microns, depending on the product being made. Curing is accomplished at steps S5 and S6 by IR heaters of about 400-700° F. and by knife nozzle of about 130-230° F. in various spots.

The third coating is applied in step S4A at some point downstream of step S4 and is an optional step. This step is applies a clear top coating or glitter top coating by the slot curtain coating die. This step makes the nail polish film and resultant appliqué extremely shiny and makes film stronger and longer lasting. The coating thickness is 15-30 micron, and the curing is by 500-800° F. IR heaters and 160-250° F. hot air by knife nozzle in various spots.

The fourth and final coating is applied at step S7 as a final preferably clear top coat. This process makes for a smooth surface and strong film. The coating thickness is 10-20 micron, and curing at steps S8 and S9 is by 500-800° F. IR heaters and 160-250° F. hot air by knife nozzle.

Thereafter, a handling strip, preferably of shiny foil, is applied at step S10 by roller, and a top layer of plastic is applied at step S11. The film is then die cut at step S12 into the specific nail-shaped appliqués that will be described below. Finally, a vacuum conveyor moves the finished product along for final processing at step S13.

Figure 12:
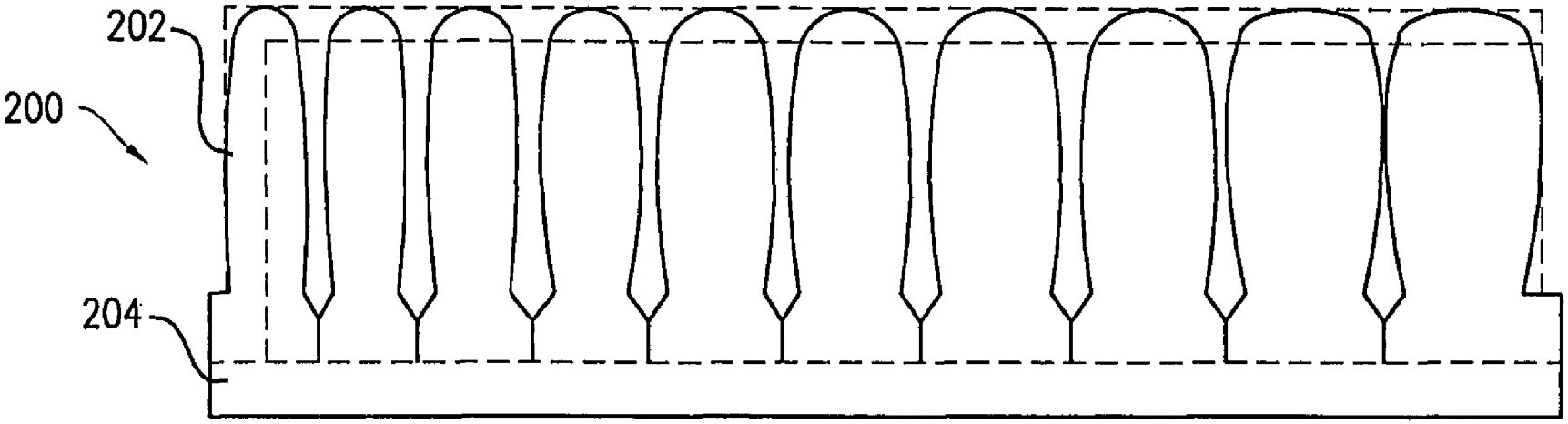
FIG. 12 is an elevational view of a cut final nail appliqué product in accordance with the invention.
Figure 13:
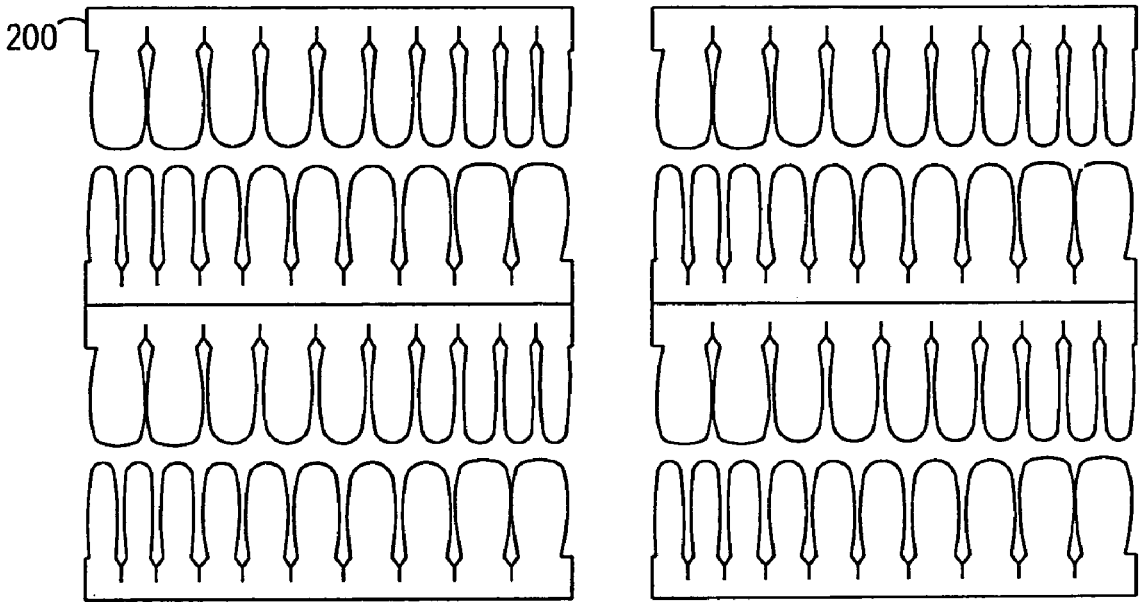
FIG. 13 is an elevational view of another cut final nail appliqué product in accordance with the invention.
Figure 14:
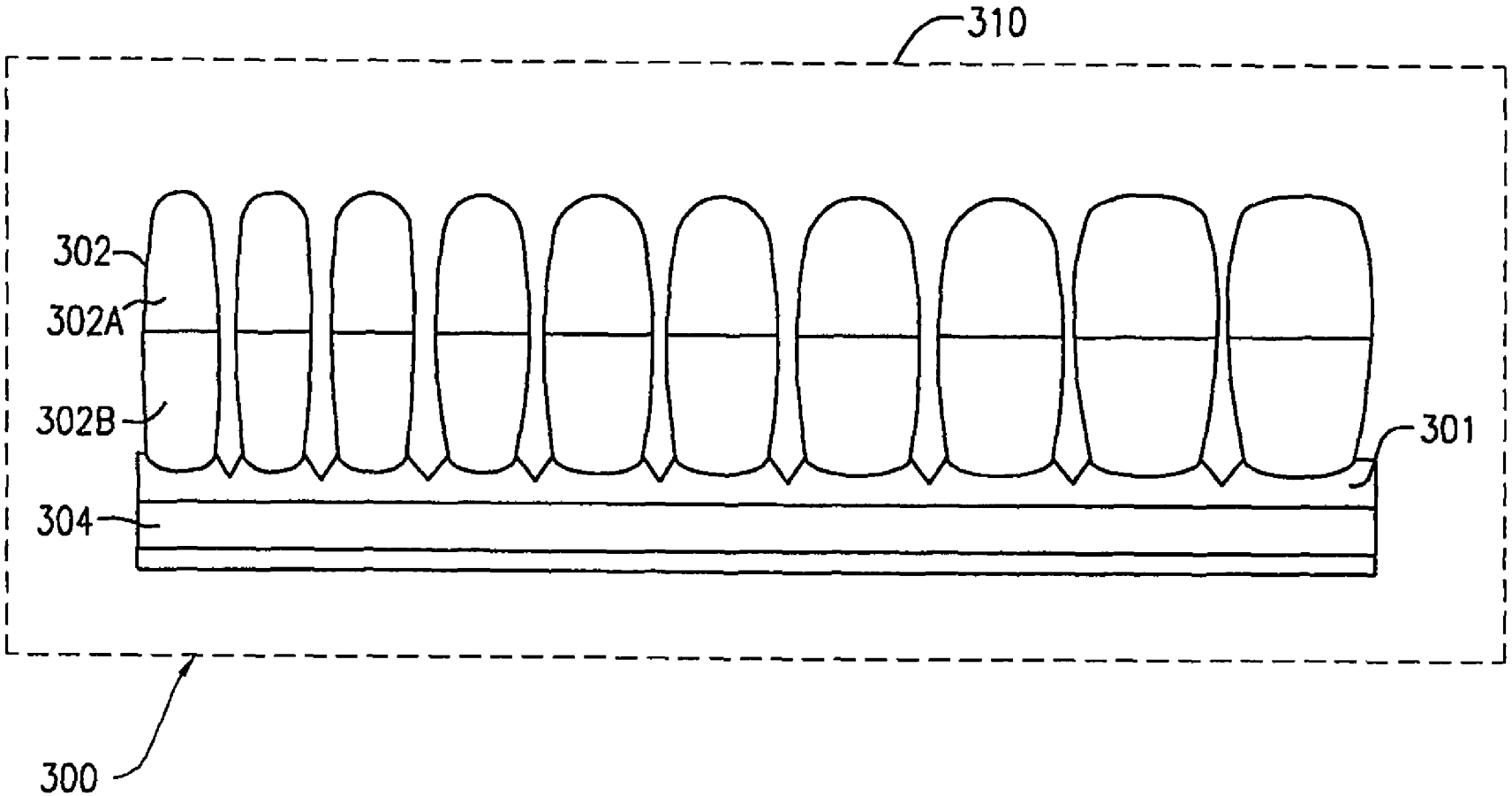
FIG. 14 is an elevational view of yet another cut final nail appliqué product in accordance with the invention having double-ended appliqués.

Various final versions of the appliqués are shown in FIGS. 12-14. In FIG. 12, a basic set 200 of nail appliqués 202 is shown. Each appliqué is roughly nail-shaped, and a set of ten different sizes of appliqués are preferably provided. A strip of foil 204 enables better and easier handling of the product. The nail shapes are formed preferably during the die-cutting step S12 of FIG. 11. Typically, more than one set 200 is cut from the same portion of a film. FIG. 13 shows multiple sets 200 being cut in a single die cutting step from a single portion of the film.

The shapes of the nail appliqués 200 in FIGS. 12 and 13 are similar to those of the prior So patent. These provided ten different sizes of appliqués. Another advance of the instant invention is shown in FIG. 14. The inventive set 300 of nail appliqués 302 are double-ended, in that one end 302A is one size and the opposite end 302B of the same appliqué is a different size than end 302A. In this configuration, twenty different sizes of appliqués are available for the user to apply to her fingernails.

In use, the user cuts open plastic 310 (which is provided to prevent the semi/dry product from completely drying out) and peels appliqués 302 from backing paper 301. Typically, the user would hold set 300 at strip 304 for ease of handling. Then, one end 302A or B of the selected appliqué 302 is placed atop a given fingernail or toenail. The user presses down on the nail to activate the adhesive, smooths out any wrinkles, and cuts any excess film from around the nail (either with a manicure scissor or with her fingernail). The result is an instant manicure without having to go to a salon.

Figure 17:
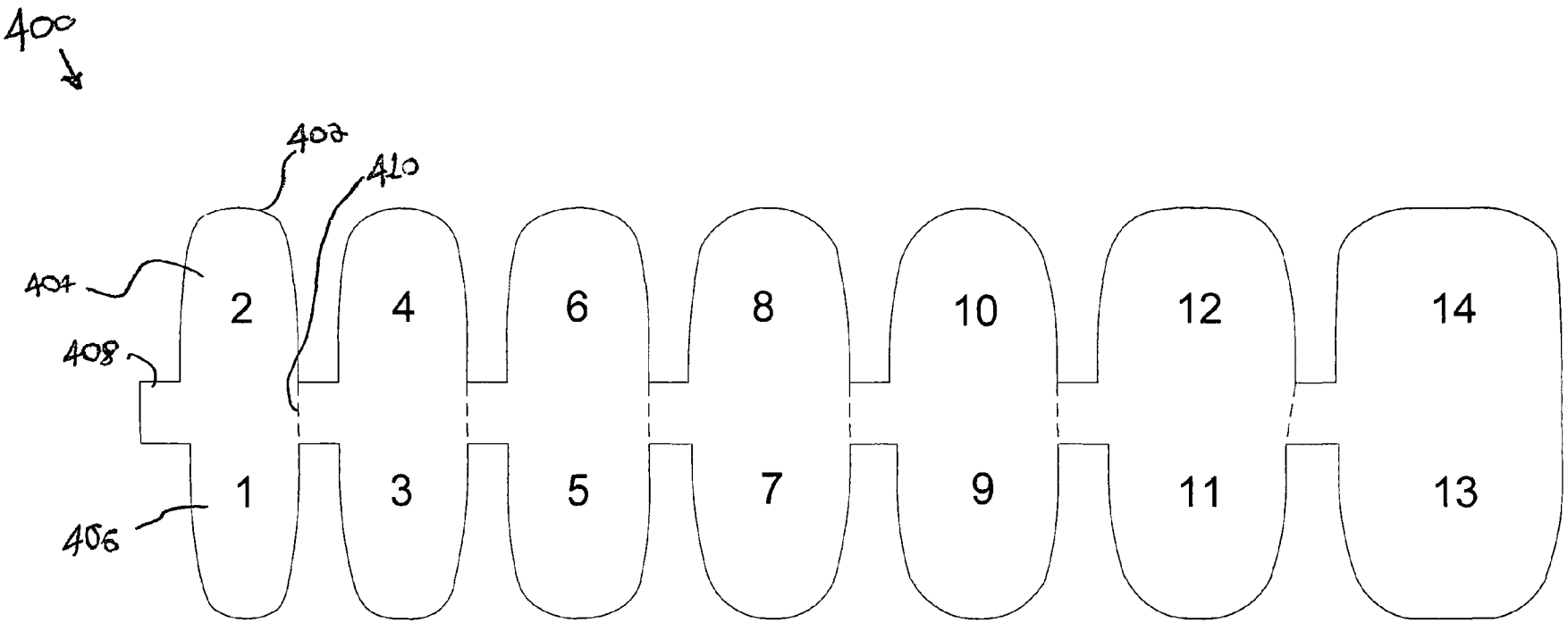
FIG. 17 is a top elevational view of yet another embodiment of a set of nail appliqués in accordance with the invention.

FIG. 17 shows an improvement to the double-ended appliqués of FIG. 14. Because the various layers (substrate, enamel, etc.) are the same as in the previous embodiments, their description will not be repeated. A set 400 of appliqués 402 are provided integrally attached to one another. Each appliqué 402 has a first end 404 and a second end 406. Each end 404, 406 is adapted to be placed on a fingernail. It has been found that in handling the double-ended appliqués of FIG. 14 and placing one end on a fingernail, the other end of the same appliqué is frequently torn, folded on itself, or otherwise rendered unusable for a different finger. Thus, in using the FIG. 14 embodiment, one typically is limited to using one or the other end of a given appliqué rather than using both ends of the same appliqué. The FIG. 17 embodiment offers more flexibility in that each appliqué 402 also includes a handling tab 408 projecting roughly midway from the side of appliqué 402. In this way, when the user grasps the appliqué, she holds handling tab 408 instead of one of the ends 402, 404, thereby enabling the use of both ends of the same appliqué. Side tab 408 is integrally attached to its respective appliqué 402 and partially attached to an adjacent appliqué 402 via a score, partial cut, perforation, etc., all represented by partial cut 410. In the preferred embodiment, the rotary cutting die that cuts the overall shape of the appliqué set 400 simultaneously creates partial cut 410.

The invention is not limited to the above description. For example, while slot die coating is preferred for applying the high viscosity nail enamel, a gravure method may be employed.

Having described the invention in terms of its preferred embodiments, the invention is not limited in scope by the above description but rather by the claims appearing hereinbelow and includes any and all equivalents known by those of skill in the art.

What is claimed is:

1. A self-adhesive nail appliqué for applying a French style manicure, comprising:

a removable substrate;

an adhesive layer applied atop said substrate;

an enamel layer applied atop of said adhesive layer, wherein said enamel layer comprises two different sized, separable enamel sections, wherein the first of said enamel sections comprises a curved border, said curved border to be applied to and to conform to a fingernail tip, and wherein the second of said enamel sections comprises a substantially fingernail-shaped appliqué to be applied atop an entire fingernail;

said first enamel section further comprising nail enamel of a first color and said second enamel section further comprising nail enamel of a second color;

wherein said first enamel section and said second enamel section are divided by a score;

wherein each of said enamel sections comprises enamel having different formulations.

2. A self-adhesive nail appliqué according to claim 1, wherein said formulations of nail enamel comprise at least 35% solid content by weight.

3. A self-adhesive nail appliqué according to claim 1, wherein said formulations of nail enamel comprise 60-80 second nitrocellulose as a predominant solid.

4. A self-adhesive nail appliqué according to claim 3, wherein said formulations of nail enamel comprise 60-80 second nitrocellulose at 6% or greater by weight.

5. A self-adhesive nail appliqué according to claim 1, wherein said formulations are of different viscosities.

6. A self-adhesive nail appliqué according to claim 1, wherein said appliqué is substantially fingernail-shaped.

7. A self-adhesive nail appliqué according to claim 6, said appliqué comprising a first section and a second section, wherein said first section includes a first of said formulations and said second section includes a second of said formulations, said first section comprising a relatively small substantially crescent-shaped area and said second section comprising substantially the remainder of said appliqué.

* * * * *